United States Patent [19]

Stewart et al.

[11] Patent Number: 4,486,915

[45] Date of Patent: Dec. 11, 1984

[54] FLOCKED HAIR BRUSH

[75] Inventors: James B. Stewart, Randolph, N.J.; Paul Bertelsen, Kalundborg, Denmark

[73] Assignee: Clairol Incorporated, New York, N.Y.

[21] Appl. No.: 456,206

[22] Filed: Jan. 7, 1983

[51] Int. Cl.[3] ..... A46B 9/02

[52] U.S. Cl. ..... 15/187; 15/159 A; 15/DIG. 5; 132/37 R; 132/85

[58] Field of Search ..... 15/160, 186, 187, 188, 15/159 A, 159 R, DIG. 5; 132/39, 40, 37 R, 120, 85

[56] References Cited

U.S. PATENT DOCUMENTS

| | | | |
|---|---|---|---|
| 2,507,373 | 5/1950 | Finkelstein | 132/120 |
| 3,566,886 | 3/1971 | Solomon | 132/39 |
| 3,888,266 | 6/1975 | Weldon | 132/39 |
| 4,267,851 | 5/1981 | Plaisted | 132/39 X |
| 4,329,567 | 5/1982 | Kunz et al. | 132/85 |

FOREIGN PATENT DOCUMENTS

| | | | |
|---|---|---|---|
| 2846588 | 5/1979 | Fed. Rep. of Germany | 132/85 |
| 4196 | of 1888 | United Kingdom | 132/120 |

*Primary Examiner*—Peter Feldman

*Attorney, Agent, or Firm*—Stuart E. Krieger; Gene Warzecha

[57] ABSTRACT

A hair brush is provided with flock on the outer tubular surface of the brushing portion. The flock is applied directly to the outer surface or mounted on a ribbon which is adhesively applied or mechanically secured to the outer surface. The bristles may also be flocked.

8 Claims, 4 Drawing Figures

FLOCKED HAIR BRUSH

DESCRIPTION

BACKGROUND OF THE INVENTION

1. Field of the Invention

The present invention relates generally to hair grooming devices and more particularly to hair brushes.

2. Description of the Invention

Hair brushes conventionally have a plurality of bristles projecting from the outer surface of the brush body; with the portion of the outer surface between the bristles being smoothly coated. Although this smooth coating reduces the friction between the brush and user's hair so as to facilitate movement during the brushing process, it provides certain drawbacks. In particular, when the outer surface of the upper layer of hair, which is often the portion of a coiffure most noticeable to others, is moved against the smooth outer surface of the brush body during grooming, there is a minimization of desired rubbing. The rubbing is necessary to provide both the upper hair layer with the softness which facilitates manageability, including the formation of curls when subsequently wound about a tubular structure, and the outer surface with the glisten normally associated with healthy and attractive hair.

Similarly, the bristles themselves are typically composed of plastic or metal, having a smooth external surface. During brushing, the relatively insubstantial frictional contact provided along the length of the hair strands by the lateral portions of the smooth bristles fails to produce, in the absence of relatively numerous brushing strokes, the desired softness or glisten to the numerous strands of hair brought in contact therewith.

It is accordingly an object of the present invention to provide a hair brush which provides enhanced rubbing by the outer surface of the brush body during brushing so as to produce a softness and a glisten to the hair, with fewer brush strokes, then presently available devices.

It is another object of the present invention to provide a hair brush having bristles with an outer surface having an improved surface which ameliorates the contact and rubbing along the length of the hair strands during brushing.

SUMMARY OF THE INVENTION

These and other objectives are accomplished in accordance with the present invention wherein there is provided a hair brush comprising: a handle portion; and a tubular brushing portion extending from the handle portion and having a plurality of longitudinal bristles projecting therefrom, at least some of the bristles being suitably elongated for penetrating through multiple layers of hair, the brushing portion having flock between the bristles for contacting the outer layer of hair during grooming. In an alternative embodiment, both the tubular brushing portion and the bristles have flock on their surfaces.

The flock may be applied directly to the outer surface of the tubular portion or, alternatively, the flock may be mounted on a strip or ribbon of material which is adhesively applied, or mechanically mounted, onto the outer surface of the tubular portion.

BRIEF DESCRIPTION OF THE DRAWINGS

The foregoing and other objects, characteristics and advantages of the present invention will be more clearly understood from the following description when read in conjunction with the accompanying drawings in which.

DESCRIPTION OF THE PREFERRED EMBODIMENTS

Figure 1:
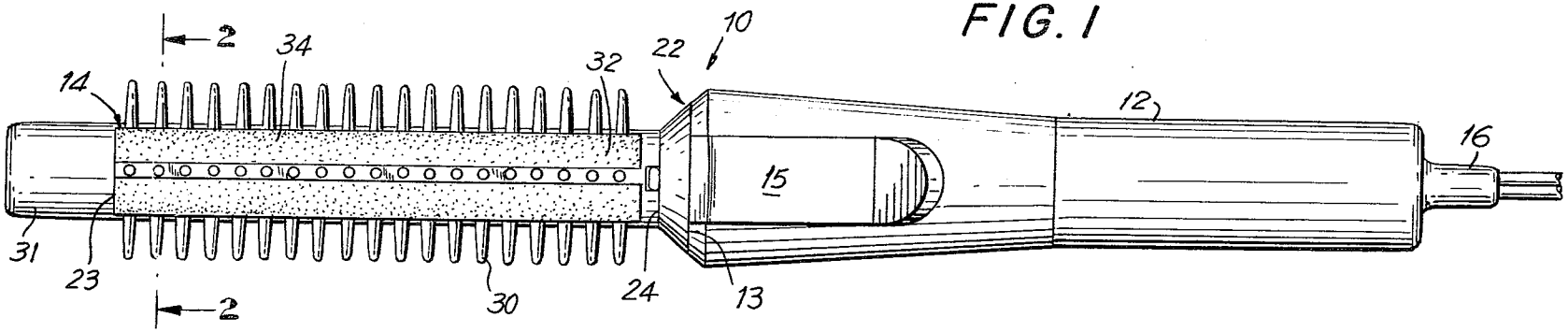
FIG. 1 is top plan view of a hair brush in accordance with the present invention.
Figure 2:
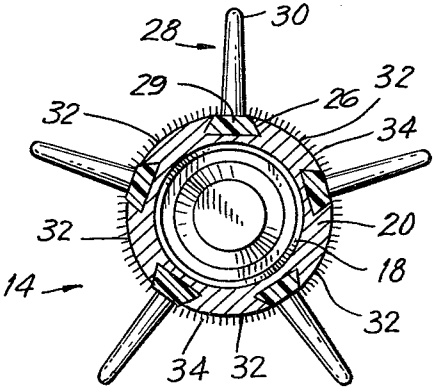
FIG. 2 is a cross-sectional view taken along line 2—2 of FIG. 1.

Referring now to the FIGS. 1 and 2, wherein the hair brush of the present invention, designated generally by the numeral 10, includes a handle portion 12 and a rotatable tubular brushing portion 14. The hair brush is hollow and has an inner mechanism which may be any of the rotatable types disclosed in the art, which produce heat and/or steam e.g. U.S. Pat. No. 4,329,567 to Kunz, et al., commonly assigned herewith. An electric cord 16 connected to an outside power source energizes the inner mechanism.

The brushing portion 14 includes an inner tube 18 which serves to rotatably support an outer tube 20. The brush 10 has a locking mechanism generally indicated by the numeral 22, in accordance with devices known in the art. For example, a brake pad (not shown), which is mounted on the handle portion 12, is spring loaded so as to engage a flange 13 of the outer tube 20 and prevent its rotation. Activation of a button 15 disengages the brake pad so as to permit the outer tube 10 to rotate freely about the inner tube 18. Other known braking mechanisms include those disclosed in Belgian Pat. No. 867075, and U.S. Pat. Nos. 4,314,137 and 4,365,140.

The outer tube 20 is preferably composed of aluminum and extends from the front end 23 to the rear end 24 of the flange 13 with grooves 26 running longitudinally along its length. The grooves 26 are preferably dovetail shaped. Each groove 26 receives in sliding relationship a strip of material, generally indicated by the numeral 28, preferably composed of a rubbery plastic, which conducts the heat from the aluminum outer tube 20 into the hair in contact therewith during brushing or styling. The strips 28 each have a dovetail base 29 which mates with the grooves 26 so as to facilitate sliding of the strips into the grooves 26 while preventing the strip 28 from outward movement. Projecting from the base 29 of each strip 28 are bristles 30 having a length adequate to penetrate from the outer layer of hair through multiple layers, typically reaching the scalp. A length of about 6.5 mm has been found preferable. A cap 31 mounted at the end of the brushing portion 14 prevents the strips 28 from sliding out. The strips 28 may have apertures (not shown) to permit steam or other vapor to be expelled therethrough.

The body portions 32 situated between the strips 28 are coated with flock 34. This can be done by methods well known in the art. For example, as described in U.S. Pat. No. 3,888,266 to Weldon et al., the short filaments are applied electrostatically onto a surface coated with a thin layer of glue. A myriad of synthetic plastic materials are appropriate for the filament composition. The preferred filaments of the present invention are composed of nylon and have a length of less than about 2.5 mm with a denier of about 22. Clearly, other lengths and fineness are suitable. These filaments 34 have one end secured by glue to the surface of the brushing portion 14 and are oriented in a direction generally normal to the surface and outwardly therefrom, while terminating in a free outer end. There are tens of thousands of filaments per square inch of surface; the density being adequate to prevent penetration of multiple layers of hair into the flocked surface. The non-hygroscopic nature of the material makes it particularly effective for use with hair treated with liquids since little of the liquid is absorbed by the material but rather is available to chemically treat the hair.

In accordance with the present invention, an alternative approach utilizes a flocked strip or ribbon. The flock is electrostatically mounted on a flat ribbon of heat resistant material, such as a polyester, having a coating of glue. The ribbon is provided with an underside which is suitable for mechanical mounting on the brushing portion. For example, the ribbon is equipped with a dovetail base which mates with a dovetail groove in the brushing portion. More preferably, however, attachment to the brushing portion can be achieved by removing a protective strip from the underside of the ribbon so as to expose an adhesive coating followed by contacting and adhering the ribbon to the brushing portion. With an appropriate adhesive the ribbon can be removed from the brushing portion so as to permit replacement. The choice of adhesive is also dependent on the temperature reached and whether steam is expelled through apertures in the tubular brushing surface.

During brushing, the flock between the bristles retains the hair thereagainst, reduces hair slippage along the brush body, and improves rubbing of the hair strand; all of which are desirable when the brushing portion is in the locked position and the unlocked, or rotatable position.

When in a locked position, the hair may be brushed with, or wound about, the brushing portion. During brushing, the bristles penetrate through layers of the user's hair towards the scalp, while the flocked outer surface of the brushing portion contacts the outer surface of the external layer of hair so as to produce an ameliorated rubbing effect along the strands of hair piled thereagainst and brought in contact therewith. Also, the flock acts to grasp the hair so as to retain the hair thereagainst during the sliding or rubbing of the hair along the flocked surface during brushing. The enhanced rubbing produces softer hair and a glisten with few brush strokes. The softer hair facilitates manageability, including the formation of curls when the hair is subsequently wound about the brushing portion.

When the hair is wound about the locked brushing portion to achieve curling, the flocked surface in conjunction with the bristles permits tensioning of the wound hair without slippage and, consequently, greater tightness can be obtained resulting in a better curl. Upon release of the locking mechanism so as to permit rotation of the brushing portion, the stroke required to remove the hair from the brushing portion rubs the hair strands longitudinally during its release.

Figure 3:
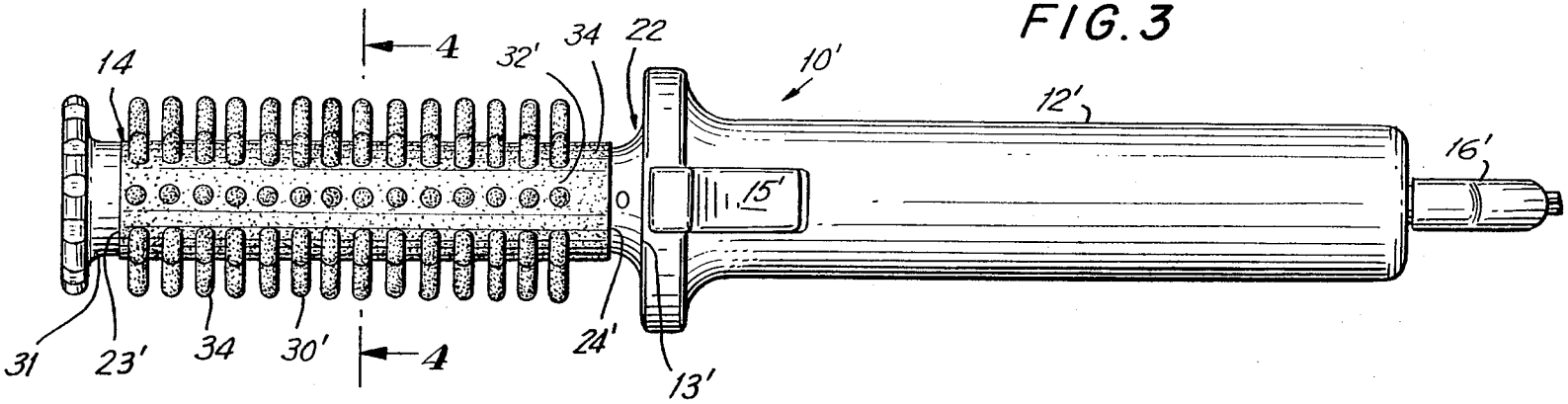
FIG. 3 is a top plan view of an alternative embodiment of a hair brush in accordance with the present invention.
Figure 4:
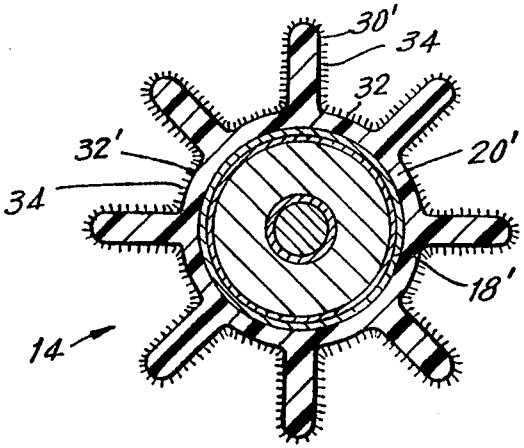
FIG. 4 is a cross-sectional view taken along line 4—4 of FIG. 3.

FIGS. 3 and 4 show another embodiment of the present invention, wherein the structure similar to that shown in FIGS. 1 and 2 are designated with the same reference numerals having a prime appended thereto. A rotatable hair brush, generally designated by 10', has a handle 12' and a brushing portion 14', which includes a completely flocked outer surface 32' and completely flocked bristles 30'. Partial flocking of the surface 32' and bristles 30' is also contemplated. This is preferably achieved by coating an integrally molded plastic mandrel with a layer of glue and applying the flock in an electrostatic field. With this structural arrangement, multiple hairs beneath the outer layer are grasped by each of the lateral elongated flocked bristle surfaces 30' and rubbed therealong during the brushing process so as to produce soft hair and a glisten.

Flocking of the bristles alone, while contemplated, is not as preferable as flocking both the outer surface and bristles.

While the invention has been described above with respect to specific embodiments, it should be clear that these embodiments are given by way of example and shall not be deemed as limiting the scope of the invention, except in accordance with the spirit and scope of the appended claims.

The invention claimed is:

1. A hair brush comprising:

a handle portion; and a tubular brushing portion extending from said handle portion and having a plurality of longitudinal bristles projecting therefrom, at least some of said bristles being suitable elongated for penetrating through multiple layers of hair, said brushing portion having flock between said bristles for contacting the outer hair layer during movement of said bristles through said layers of hair, said flock comprising a plurality of fine filaments, each filament having a length of less than about 2.5 mm, the density of the flock being sufficient to prevent a substantial number of layers of hair from penetrating into the flock.

2. The hair brush of claim 1 wherein said bristles include at least some flock on its outer surface.

3. The hair brush of claim 1 wherein said bristles extend in longitudinal rows along said tubular portion and said flock extends longitudinally between said rows.

4. The hair brush of claim 1 wherein said bristles and tubular portion are completely flocked.

5. The hair brush of claim 1 wherein said flock is mounted on a ribbon and is secured to the outer surface of said tubular portion.

6. The hair brush of claim 5 wherein said ribbon is removable.

7. The hair brush of claim 1 wherein said flock is adhesively applied directly to said tubular portion.

8. The hair brush of claim 1 wherein said tubular brushing portion is rotatably lockable with respect to said handle portion.

* * * * *